US010311762B2

(12) United States Patent
Pizzi

(10) Patent No.: US 10,311,762 B2
(45) Date of Patent: Jun. 4, 2019

(54) LABEL-HOLDER ELEMENT FOR ELECTRIC WIRES

(71) Applicant: Morsettitalia S.p.A., Milan (IT)

(72) Inventor: Giordano Pizzi, Milan (IT)

(73) Assignee: MORSETTITALIA S.P.A., Milan (IT)

( * ) Notice: Subject to any disclaimer, the term of this patent is extended or adjusted under 35 U.S.C. 154(b) by 0 days.

(21) Appl. No.: 15/298,617

(22) Filed: Oct. 20, 2016

(65) Prior Publication Data

US 2017/0148362 A1 May 25, 2017

(30) Foreign Application Priority Data

Oct. 21, 2015 (IT) ..... 102015000063843

(51) Int. Cl.
*G09F 3/20* (2006.01)
*H01R 9/24* (2006.01)
(Continued)

(52) U.S. Cl.
CPC ..... *G09F 3/205* (2013.01); *G09F 3/08* (2013.01); *H01B 7/368* (2013.01); *H01R 9/2475* (2013.01); *H01R 13/465* (2013.01)

(58) Field of Classification Search
CPC ..... H01B 7/368; G09F 3/205; G09F 3/202; G09F 3/00; G09F 3/06
See application file for complete search history.

(56) References Cited

U.S. PATENT DOCUMENTS 1,484,413 A * 2/1924 Roberge ..... G09F 3/20 40/652
3,068,600 A * 12/1962 Blanchet ..... G09F 3/06 40/316
(Continued)

FOREIGN PATENT DOCUMENTS

DE 655749 C 1/1938
DE 973473 C 3/1960
(Continued)

OTHER PUBLICATIONS

Vautrin, F.; Search report & written opinion from priority Italian Application No. 102015000063843 (IT UB20154814); search completed Jun. 21, 2016.
(Continued)

*Primary Examiner* — Cassandra Davis

(57) ABSTRACT

Label-holder element for electrical wires (200), comprising a body (410; 510) extending in a longitudinal lengthwise direction (X-X), transverse widthwise direction (Y-Y) and vertical thickness direction (Z-Z), with a front face (10*a*) provided with a seat (20) for labels (30), side faces (410*b*) and a rear face (410*c*), said seat (20) having opposite top (20*a*) and bottom (20*b*) edges which extend in the transverse direction (Y-Y), are arranged opposite each other in the longitudinal direction (X-X) and are formed in the manner of engaging means (21,22) for retaining a label (30); means for coupling with an electrical wire (200) comprising at least one pair (440; 540) of teeth (441; 541) extending outwards from the rear surface (410*c;* 510*c*) in the vertical direction (Z-Z), the teeth (441; 541) of one pair having a free end (441*a;* 541*a*) directed towards the other tooth in the transverse direction (Y-Y) and being arranged staggered in the longitudinal direction (X-X) for mounting on/engagement with a wire (200).

12 Claims, 2 Drawing Sheets

Figure 1:
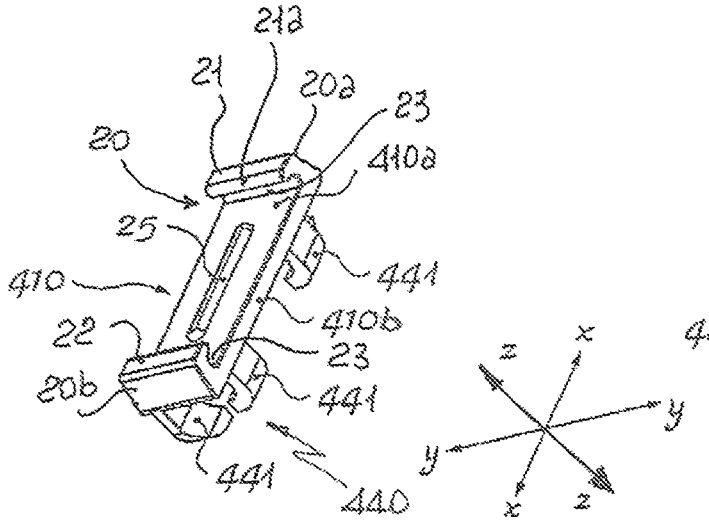

(51) Int. Cl.

| | |
|---|---|
| ***H01R 13/46*** | (2006.01) |
| ***H01B 7/36*** | (2006.01) |
| ***G09F 3/08*** | (2006.01) |

(56) References Cited

U.S. PATENT DOCUMENTS

| | | | | |
|---|---|---|---|---|
| 3,804,330 | A * | 4/1974 | Miller, Jr. | B65F 7/00 239/34 |
| 4,518,080 | A * | 5/1985 | Ohlson | A45C 11/18 206/37 |
| 5,275,282 | A * | 1/1994 | Ross | G09F 3/16 206/389 |
| 6,553,702 | B1 * | 4/2003 | Bacnik | G09F 3/204 40/649 |

FOREIGN PATENT DOCUMENTS

| | | | |
|---|---|---|---|
| DE | 2020383 | A1 | 11/1971 |
| DE | 8506254 | U1 | 7/1985 |
| DE | 3932066 | C1 | 11/1990 |
| DE | 202004010070 | U | 11/2005 |
| DE | 202008013609 | U | 11/2009 |
| DE | 202009003250 | U1 | 7/2010 |
| DE | 202013102301 | U1 | 9/2014 |
| FR | 76932 | E | 12/1961 |
| JP | S60112278 | U | 7/1985 |
| WO | 85/03800 | A1 | 8/1985 |

OTHER PUBLICATIONS

Vautrin, F.; Search report & written opinion from corresponding European Application No. 16194754.4; search completed Mar. 6, 2017.

* cited by examiner

LABEL-HOLDER ELEMENT FOR ELECTRIC WIRES

The present invention relates to a label-holder element for electrical cable wires.

It is known, in the technical sector relating to the construction of switchboards for the wiring of electrical installations, to use terminal blocks adapted to be mounted on associated mounting rails and to provide access on the front to the means—normally of the screw type—for retaining the electrical connection wires which form the electric circuit.

It is also known that, owing to the increasingly greater complexity of electric switchboards, it is necessary to mount on each electric wire a corresponding identification label which must be visible at the front for reading by the user.

It is also known that on the market there exist different types of wires which each have a different cross-section, so that it is not possible to standardize the different types of labels, as well as different types and sizes of writing to be applied on them.

Examples of the prior art are described in DE 85 06 254 U1 and DE 20 2004 010070 U1.

The technical problem which is posed therefore is that of providing a label-holder element which is able to allow easy and safe coupling with/uncoupling from different types of electrical wires, while ensuring the features of safety, prevention of accidental removal of the label and good visibility of the label by the user.

In addition it is also desirable to achieve a greater standardization of the label and the associated writing.

In connection with this problem it is also required that the label-holder element should be easy and low-cost to produce and that it may be quickly mounted on/removed from the electrical wire.

These results are obtained according to the present invention by a label-holder element according to the characteristic features of claim 1.

The label-holder element for electrical wires, comprises a body extending in a longitudinal lengthwise direction, transverse widthwise direction and vertical thickness direction; and at least one pair of teeth extending outwards from the rear surface in the vertical direction for coupling with an electrical wire.

The body comprises a front face provided with a seat for a label, side faces opposite to each other in the transverse direction, a rear face opposite to the front face in the vertical direction. The seat has a top edge and a bottom edge which extend in the transverse direction, are arranged opposite each other in the longitudinal direction and are formed so as to engage and retain a label.

The teeth of one pair for coupling with a wire have a free end directed towards the other tooth in the transverse direction and are arranged staggered in the longitudinal direction for mounting on/coupling with a wire.

Preferably, the label engaging edges are formed in the manner of a respective tooth, each tooth forming a corresponding undercut towards the inside of the seat.

Each tooth of the seat may extend over the entire width of the seat in the transverse direction and/or have a rounded edge directed towards the inside of the said seat.

The rear face of the body may be bounded by opposite transverse edges and at least one pair of coupling teeth may extend outwards in the vertical thickness direction from the opposite transverse edges of the rear face of the body.

The two teeth of the pair are preferably elastically deformable in the transverse direction and/or have a respective chamfered free end.

According to a preferred embodiment, the element of the invention comprises a longitudinal rib which extends in the longitudinal direction for connecting together the free ends of the coupling teeth of a pair and with them defines an open space in the longitudinal direction for allowing mounting of the label-holder element on a wire or vice versa insertion of the wire in the label-holder element. Preferably the label-holder element comprises at least two pairs of teeth for coupling with a wire, which are spaced from each other in the longitudinal direction, and said longitudinal rib connects the free ends of all the coupling teeth.

The seat may have lateral flanks open in the transverse direction for inserting the label from one side or the other side in the same transverse direction.

At least one relief may extend in the vertical direction on the front surface of the seat; the at least one relief is preferably arranged in a central position with respect to the transverse extension of the seat.

The front surface of the seat may comprise a depression.

Figure 2:
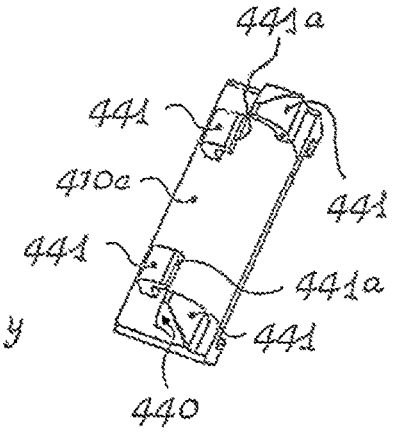
Figure 3:
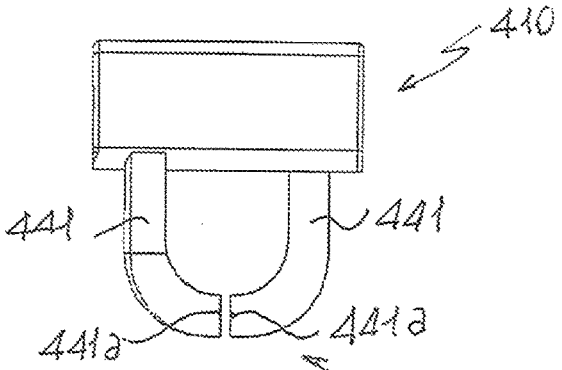
Figure 4:
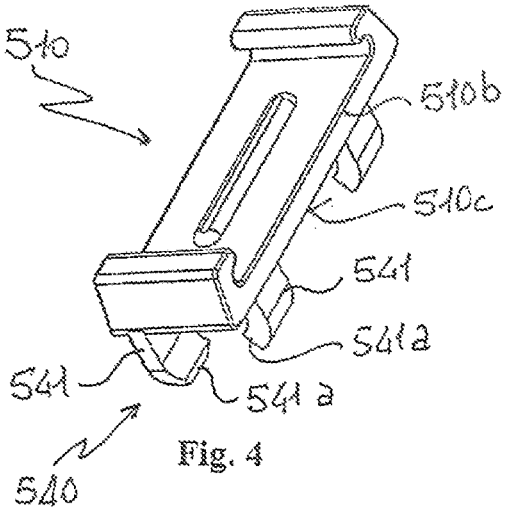
Figure 5:
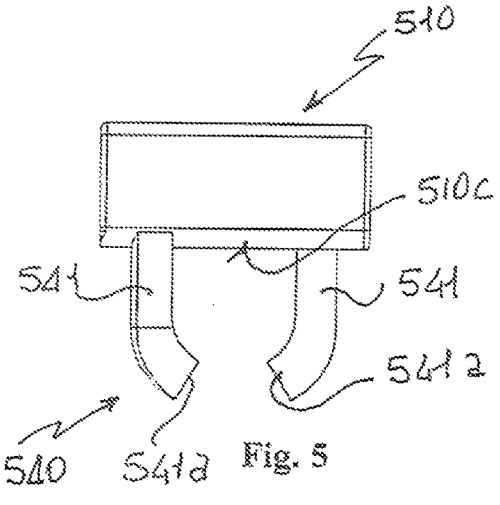
Figure 6:
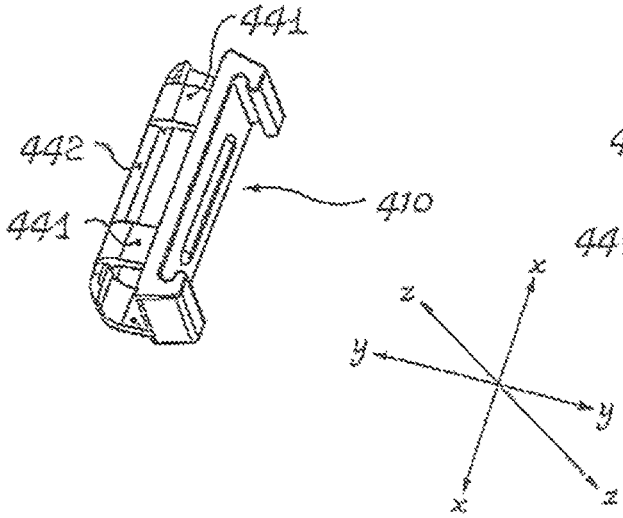
Figure 7:
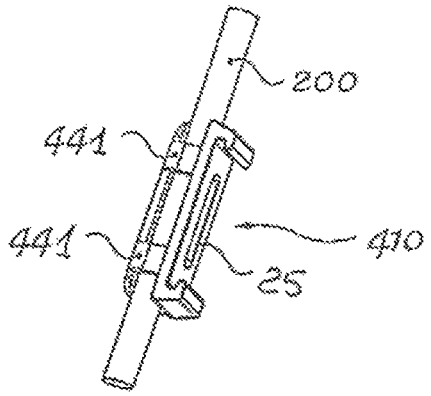
Figure 8A:
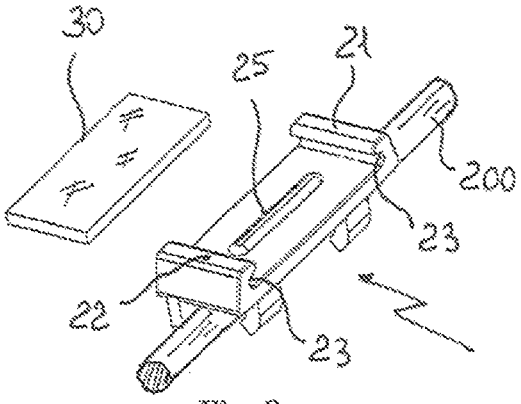
Figure 8B:
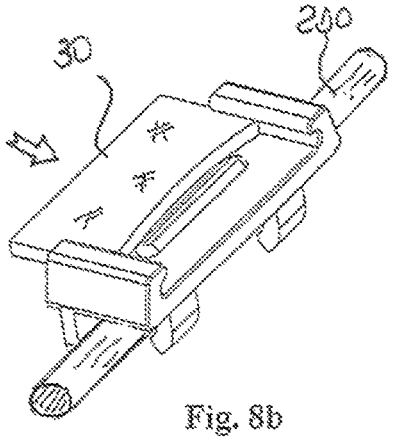
Figure 8C:
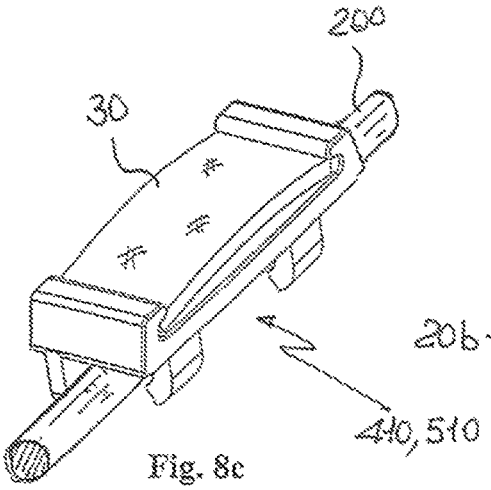
Figure 9:
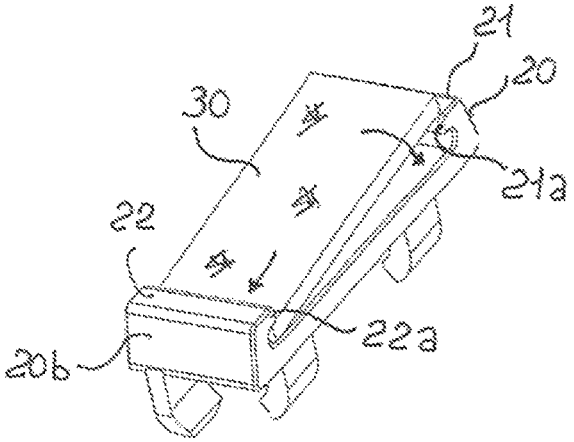

Further details may be obtained from the following description of non-limiting examples of embodiment of the subject of the present invention, provided with reference to the accompanying drawings, in which:

FIG. 1: shows a perspective view, from the front, of a first example of embodiment of a label-holder element according to the invention;

FIG. 2: shows a perspective view, from behind, of the label-holder element according to FIG. 1;

FIG. 3: shows a front-on view of the label-holder element according to FIG. 1;

FIG. 4: shows a perspective view of second example of embodiment of a label-holder element according to the invention;

FIG. 5: shows a front-on view of the label-holder element according to FIG. 4;

FIG. 6: shows a perspective view, from the front, of a third example of embodiment of the label-holder element according to the invention;

FIG. 7: shows a perspective view, from behind, of the label-holder element according to FIG. 6;

FIGS. 8*a*, 8*b* and 8*c*: show the sequence for lateral insertion of the label in the label holder; and FIG. 9: shows the insertion, from the front, of the label in the label holder according to the invention.

As shown in FIG. 1 and assuming solely for easier description and without a limiting meaning a set of three reference axes having, respectively, a longitudinal direction X-X corresponding to the greater dimension or length of the label-holder element and the label; transverse direction Y-Y corresponding to the smaller dimension or width of the label-holder element and the label; vertical direction Z-Z corresponding to the thickness of the label-holder element, as well as a front or end side corresponding to the face for containing and reading the label and a rear face opposite to the front face in the vertical direction Z-Z, an example of the label-holder element comprises:

- a body 410 with a front face 410*a*, side faces 410*b* opposite to each other in the transverse direction Y-Y and rear face 410*c*, opposite to the front face 410*a* in the thickness direction Z-Z;
- a seat 20 for holding the label 30 formed in the front side 410*a* of the body 410 (FIG. 6), which seat has a top edge 20*a* and bottom edge 20*b* formed in the manner of a respective tooth 21,22 extending in the transverse direction Y-Y over the width of said seat 20.

Each tooth forms a corresponding undercut 23. Preferably said teeth 21,22 arranged opposite each other have an edge 21*a*,22*a* suitably rounded to facilitate insertion frontally of the label 30 (FIG. 9).

Although not shown, according to preferred embodiments the front surface of the seat 20 is provided with a depression for allowing the label to bend with an inwards convexity in order to facilitate insertion and engagement inside the opposite undercuts of the seat.

According to preferred embodiments at least one relief 25 is formed (FIG. 1), said relief being arranged on the bottom of the seat 20 and being designed to produce an outwards convexity of the label 30 (FIG. 8*c*).

According to further embodiments the relief 25 is designed to be inserted inside a corresponding seat (not shown) of the label 30 so as to prevent any sliding thereof and/or prevent it from coming out in the transverse direction Y-Y.

In the embodiments with a depression of the seat 20 two reliefs 25 are arranged on the outside of the depression and symmetrically relative thereto in the longitudinal direction X-X.

The rear face 410*c* of the label-holder element is provided with means for coupling with supporting devices on which an identification label 30 must be mounted.

The supporting devices consist of an electrical connection wire 200 (FIG. 6).

The means 440 for coupling the label-holder element on the wire 200 comprise at least one pair of teeth 441 extending outwards in the vertical direction Z-Z, preferably elastically deformable in the transverse direction Y-Y and suitable for coupling with the electrical wire 200.

With reference to the first embodiment 410 of the label holder according to the invention, it is also envisaged that the at least one pair 440 of teeth 441 extend outwards in the direction of the thickness Z-Z, preferably in the proximity of and/or along the opposite transverse edges of the rear face 410*c* of the label-holder element; the two teeth 441 of the pair have a free inner end 441*a* and are arranged staggered in the longitudinal direction (X-X); this configuration is particularly advantageous for production by means of molding in order to reduce the movements of the mold and facilitate extraction of the finished part.

FIGS. 4 and 5 show a further embodiment of the label holder 510 according to the invention; in this case the teeth 541 of the pair 540 have a respective free end 541*a* chamfered from the outside inwards in order to facilitate frontal engagement with the wire 200.

FIGS. 6,7 show a variation of embodiment of the label holder element according to FIG. 1, where the free end 440*a* of the teeth 440 is connected to a longitudinal rib 442.

Preferably the rib extends longitudinally until it connects the first pair of teeth 440 to the free ends of at least one further pair of teeth 440 arranged spaced from the first pair in the longitudinal direction X-X, in the example to the opposite longitudinal end of the face 410*c*.

In the embodiment shown in FIGS. 1 and 4 the label-holder element may be mounted on the wire 200 by pressing the two parts together in the radial direction relative to the extension of the wire, while in the embodiment shown in FIGS. 6 and 7 the label-holder element must be mounted on the wire—or vice versa the wire must be inserted in the label-holder element—in a direction parallel to that of longitudinal extension of the wire.

As shown, the label-holder element has a laterally open seat 20 which allows insertion/extraction of a label 30 also from the sides and both from the right and from the left (FIGS. 8*a*-8*c*), therefore also allowing the mounting of labels in strip form which can be inserted on blocks of label-holder elements arranged alongside each other and/or joined together in the transverse direction Y-Y along wires in turn arranged alongside each other.

In the specific application it is also possible to provide labels without a recess for engagement with the relief 25 since the force applied by the relief on the label causes an elastic deformation (FIG. 8*c*) which creates a reaction in the longitudinal direction X-X in the region of the teeth 21,22 and a friction in the transverse direction Y-Y on the projection such as to stably retain the label in the seat.

It is therefore clear how the label-holder element according to the invention is easy and low-cost to produce and is able to form a versatile assembly which may be easily mounted on different types of electrical wire in a stable and therefore safe and reliable manner owing to coupling elements extending from the rear face. The particular structure of the label-holder seat contributes to the formation of a very versatile element, also allowing the use of substantially flat standardized labels which have a uniform thickness and are made using different plastic and/or paper materials.

Although described in connection with a number of embodiments and a number of preferred examples of embodiment of the invention, it is understood that the scope of protection of the present patent is determined solely by the claims below.

What is claimed:

1. A label-holder element for coupling to an electrical wire and extending along a lengthwise longitudinal direction (X-X), the label holder comprising:

a body extending in the longitudinal direction (X-X) parallel in use to the longitudinal direction of the electrical wire, a transverse widthwise direction (Y-Y) and a vertical thickness direction (Z-Z), wherein the body comprises:

a front face provided with a seat for a label, side faces oppositely oriented in the transverse direction (Y-Y), and a rear face oppositely oriented to the front face in the vertical direction (Z-Z);

at least one pair (440; 450) of teeth (441; 541) extending outwardly from the rear face (410*c*; 510*c*) in the vertical direction (Z-Z) for coupling with the electrical wire (200), wherein the teeth of one pair extend outwards in the vertical direction (Z-Z) from the rear surface on opposite sides of a longitudinal-vertical plane orthogonal to the rear surface (410*c*; 510*c*), each tooth of the at least one pair of teeth having a free end directed towards the free end of the other tooth in the transverse direction, and the teeth of the at least one pair of teeth arranged staggered in the longitudinal direction for mounting on the electrical wire, and wherein the seat has a top edge and a bottom edge which extend in the transverse direction, are arranged opposite each other in the longitudinal direction and are formed so as to engage and retain the label, and wherein label-engaging means are formed in a manner of a respective tooth along each of the top edge and the bottom edge, each tooth forming a corresponding undercut towards an inside of the seat and being, in use, extended along a direction transverse to the wire, whereby the seat directly receives the label from either direction along the transverse direction (Y-Y) and/or frontally along the vertical direction (Z-Z) and the label is retained between each undercut.

2. The element as claimed in claim 1, wherein each tooth of the seat extends over the entire width of the seat in the transverse direction.

3. The element as claimed in claim 1, wherein oppositely arranged teeth of the seat have an edge which is directed towards the inside of the said seat and is rounded.

4. The element as claimed in claim 1, wherein the rear face of the body is bounded by opposite transverse edges and wherein at least one pair of teeth extends outwards in the vertical thickness direction from opposite transverse edges of the rear face of the body.

5. The element as claimed in claim 4, wherein the teeth of the pair are elastically deformable in the transverse direction.

6. The element as claimed in claim 1, wherein the teeth of the pair have a respective chamfered free end.

7. The element as claimed in claim 1, comprising a longitudinal rib which extends in the longitudinal direction for connecting together the free ends of the teeth of a pair and with them defines an open space in the longitudinal direction for allowing mounting of the label-holder element on a wire or, vice versa, insertion of the wire in the label-holder element.

8. The element as claimed in claim 7, comprising at least two pairs of teeth for coupling with a wire, which are spaced from each other in the longitudinal direction, said longitudinal rib connecting the free ends of all the coupling teeth.

9. The element as claimed in claim 1, wherein the seat has lateral flanks open in the transverse direction for inserting the label from one side or the other side in the same transverse direction.

10. The element as claimed in claim 1, comprising at least one relief extending in the vertical direction on the front face of the seat.

11. The element as claimed in claim 10, wherein said at least one relief is arranged in a central position with respect to the transverse extension of the seat.

12. The element as claimed in claim 1, wherein the front face of the seat comprises a depression.

* * * * *